United States Patent [19]

Schirmer

[11] 4,087,963

[45] May 9, 1978

[54] COMBUSTOR FOR LOW-LEVEL $NO_x$ AND CO EMISSIONS

[75] Inventor: Robert M. Schirmer, Bartlesville, Okla.

[73] Assignee: Phillips Petroleum Company, Bartlesville, Okla.

[21] Appl. No.: 679,545

[22] Filed: Apr. 23, 1976

Related U.S. Application Data

[63] Continuation of Ser. No. 456,156, Mar. 29, 1974, abandoned.

[51] Int. Cl.[2] ..... F02C 3/00; F02C 7/08

[52] U.S. Cl. ..... 60/39.23; 60/39.51 R; 60/39.65; 431/352

[58] Field of Search ..... 60/39.65, 39.69, 39.74 R, 60/DIG. 11, 39.51 R, 39.71, 39.23; 431/352, 10

[56] References Cited

U.S. PATENT DOCUMENTS

| | | | |
|---|---|---|---|
| 2,525,206 | 10/1950 | Clarke | 60/39.65 |
| 2,651,514 | 9/1953 | Sherman | 60/39.65 |
| 2,659,201 | 11/1953 | Krejci | 60/39.65 |
| 2,669,090 | 2/1954 | Jackson | 60/39.65 |
| 3,057,158 | 10/1962 | Miller | 60/39.65 |
| 3,099,134 | 7/1963 | Calder et al. | 60/39.65 |
| 3,826,078 | 7/1974 | Quigg | 60/39.65 |

FOREIGN PATENT DOCUMENTS

| | | | |
|---|---|---|---|
| 676,473 | 7/1952 | United Kingdom | 60/39.65 |

*Primary Examiner*—Carlton R. Croyle
*Assistant Examiner*—Thomas I. Ross

[57] ABSTRACT

New combustors, and methods of operating same, which produce lower emissions, particularly lower emissions of nitrogen oxides and CO. Means and methods are provided for supplying separate streams of air to primary and secondary combustion regions of a combustor, and expanding combustion products when passing same from said primary combustion region to said secondary combustion region. In preferred embodiments, unheated air can be used in said primary combustion region, and/or a second stream of air mixed with said combustion products during said expansion thereof.

13 Claims, 10 Drawing Figures

COMBUSTOR FOR LOW-LEVEL $NO_x$ AND CO EMISSIONS

This application is a continuation of copending application Ser. No. 456,156, filed Mar. 29, 1974, now abandoned.

This invention relates to new combustors and methods of operating same.

Air pollution has become a major problem in the United States and other highly industrialized countries of the world. Consequently, the control and/or reduction of said pollution has become the object of major research and development effort by both governmental and nongovernmental agencies. Combustion of fossil fuel is a primary source of said pollution. It has been alleged, and there is supporting evidence, that the automobiles employing conventional piston-type engines burning hydrocarbon fuels are a major contributor to said pollution. Vehicle emission standards have been set by the United States Environmental Protection Agency (EPA) which are sufficiently restrictive to cause automobile manufacturers to consider employing alternate engines instead of the conventional piston engine.

The gas turbine engine is being given serious consideration as an alternate engine. CO emissions in conventional prior art gas turbine processes operated for maximum fuel combustion efficiency are not usually a problem. However, nitrogen oxides emissions, usually referred to as $NO_x$, are a problem because the high temperatures generated in such prior art processes favor the production of $NO_x$. It has been proposed to reduce the temperature of the inlet combustion air flowing to the combustion apparatus so as to reduce the amount of nitrogen oxides produced. For example, see the U.S. Pat. No. to Vickers, 3,705,492, issued Dec. 12, 1972. However, there is no disclosure in said Vickers patent of what happens to the production of CO emissions. A gas turbine engine employed in an automobile or other vehicle will be operated over a wide range of varying operating conditions including idle, low speed, moderate speed, high speed, acceleration, and deceleration. These varying conditions also create serious problems in controlling $NO_x$ and CO emissions. Thus, there is a need for a combustor of practical and/or realistic design, which can be operated in a manner such that the pollutant emissions therefrom will meet said EPA standards. Even a combustor, and/or a process, giving reduced pollutant emissions approaching said standards would be a great advance in the art. Such a combustor, or process, would have great potential value because it is possible the presently very restrictive EPA standards may be reduced.

The present invention solves the above-described problems by providing new combustors, and methods of operating same, which produce lower emissions, particularly lower emissions of nitrogen oxides (usually referred to as $NO_x$) and CO. Means and methods are provided for supplying separate streams of air to primary and secondary combustion regions of a combustor, and expanding combustion products when passing same from said primary combustion region to said secondary combustion region. In presently preferred embodiments, unheated air can be used in said primary combustion region, and/or a second stream of air mixed with said combustion products during said expansion thereof.

Thus, according to the invention there is provided in a combustor comprising, in combination, a tubular outer casing, a flame tube disposed within said casing and spaced apart thereform to form a first annular chamber between said flame tube and said casing, a first air inlet means for introducing a first stream of air into the upstream end portion of said flame tube, and a fuel inlet means for introducing fuel into the upstream end portion of said flame tube, the improvement comprising a flame tube having an upstream primary combustion section, an intermediate secondary combustion section of greater cross-sectional area than said primary combustion section, and a downstream quench or dilution section; at least one opening provided in the wall of said primary combustion section at a first station located adjacent the downstream end thereof for admitting a second stream of air from said first annular chamber into the interior of said flame tube; and an annular connecting section of greater cross-sectional area than said primary combustion section disposed between said primary combustion section and said secondary combustion section, and comprising the upstream end portion of said secondary combustion section.

Further, according to the invention, there is provided a method for burning a fuel in a combustion zone having a primary combustion region, a secondary combustion region located downstream from said primary combustion region, and a quench or dilution region located downstream from said secondary region, which method comprises introducing at least a portion of a first stream of air into the upstream end portion of said primary combustion region; introducing a fuel into the upstream end portion of said primary combustion region; burning said fuel and producing gaseous combustion products; passing a second stream of air in a downstream direction as an annular stream of air in the region around said primary combustion region; introducing another stream of air, comprising a portion of at least one of (a) said first stream of air and (b) said second stream of air, into admixture with said combustion products in the downstream end portion of said primary combustion region; and passing, and expanding, said combustion products from said primary combustion region into said secondary combustion region.

Figure 3:
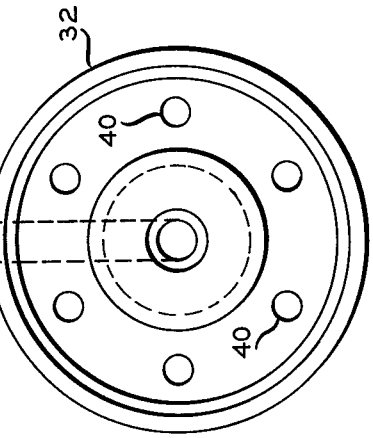
FIG. 3 is a view taken along the lines 3—3 of FIG. 2.
Figure 3A:
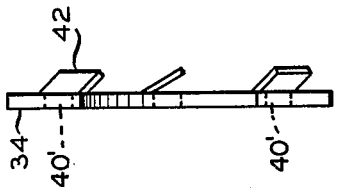
Figure 2:
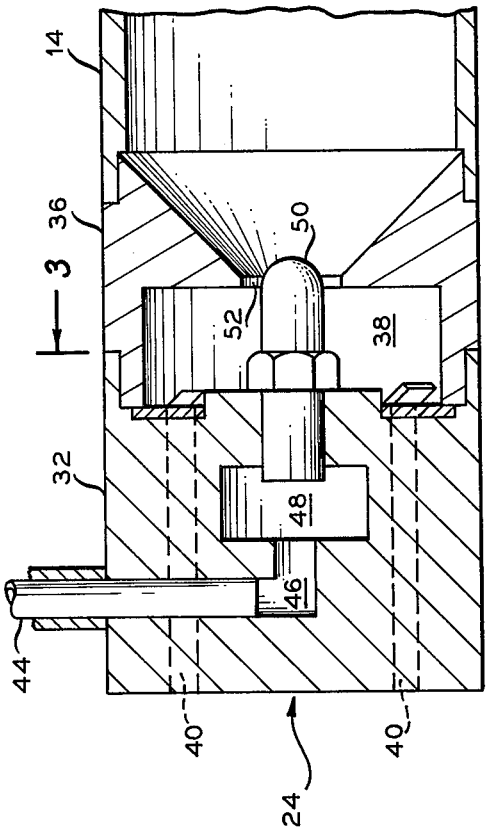
FIG. 2 is an enlarged view in cross section of the dome or closure member employed in the upstream end of the flame tube in the combustor of FIG. 1.

FIG. 3*a* is a sectional view of an element of the dome or closure member of FIG. 2.

FIGS. 4, 5, 6, and 7 are views, partially in cross section, of other combustors in accordance with the invention.

Figure 8:
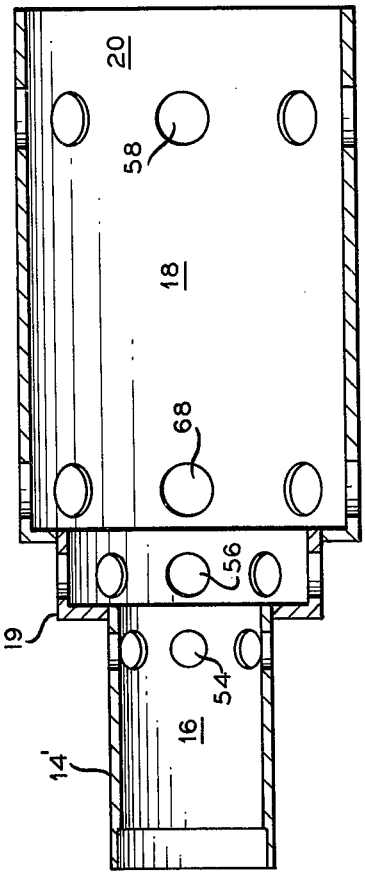

FIG. 8 is a view in cross section of another flame tube which can be employed in combustors of the invention.

Figure 9:
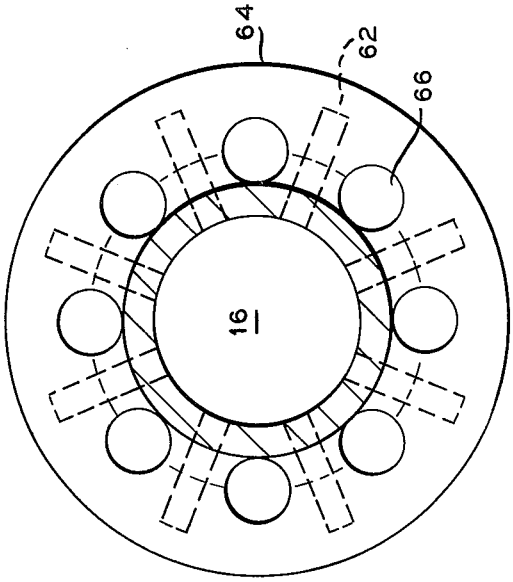
Figure 7:
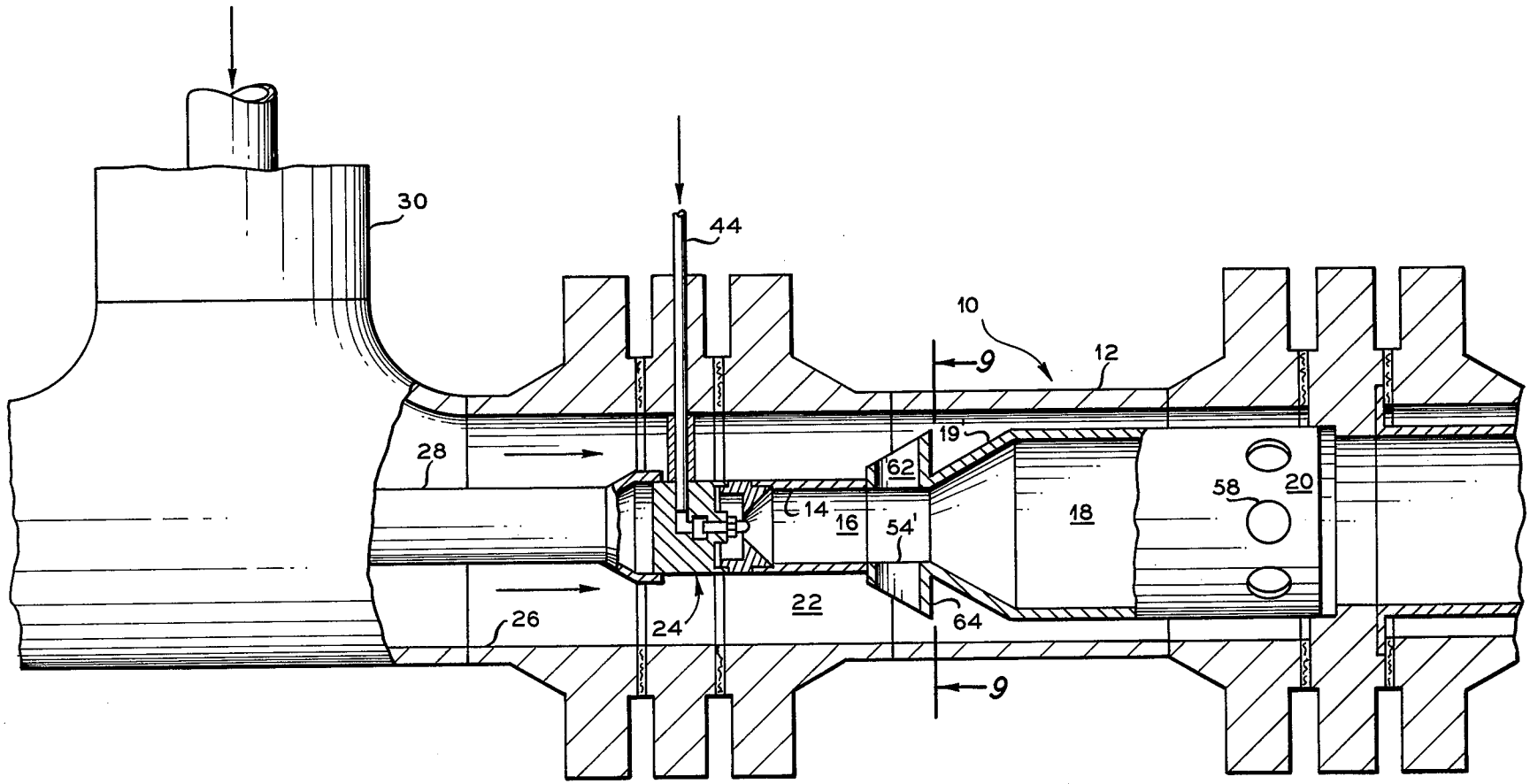

FIG. 9 is a view in cross section along the lines 9—9 of FIG. 7.

Referring now to the drawings, wherein like reference numerals are employed to denote like elements the invention will be more fully explained.

Figure 1:
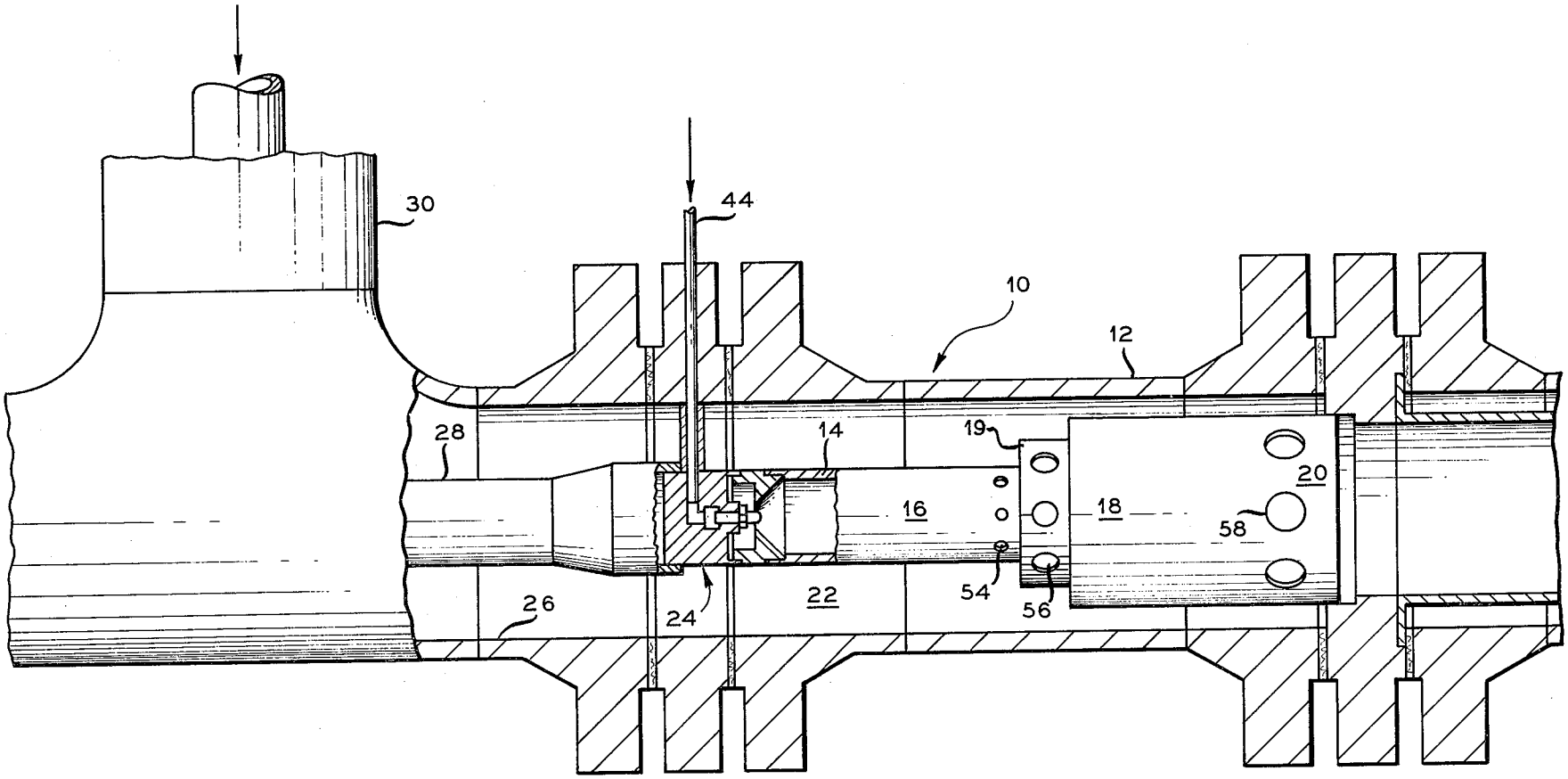
FIG. 1 is a view, partially in cross section, of a combustor in accordance with the invention.

FIG. 1 illustrates one presently preferred combustor, denoted generally by the reference numeral 10, in accordance with the invention. Said combustor comprises an outer housing or casing 12 having a flame tube 14 disposed concentrically therein. Said flame tube comprises a primary combustion section 16 disposed in the upstream portion thereof, a secondary combustion section 18 located downstream from said primary combustion section, and a dilution or quench section 20 located downstream from said secondary combustion region. An annular connecting section 19 of greater cross-sectional area than said primary combustion section is disposed between said primary combustion section 16 and said secondary combustion section 18 and comprises the upstream end portion of said secondary combustion section. Preferably, the downstream portion of said secondary combustion section is enlarged and has a greater cross-sectional area than said connecting section. In this embodiment of the invention said primary, connecting, secondary, and quench sections are preferably generally circular in cross section throughout their length.

An annular chamber 22 is formed around said flame tube and between said flame tube and said outer housing 12. Said annular chamber 22 is closed at its downstream end by any suitable means such as that illustrated. The upstream end of said flame tube is closed by a dome or closure member designated generally by the reference numeral 24, and having fuel inlet means and first or primary combustion air inlet means incorporated therein. A first air conduit 26 is connected to the upstream end of said outer casing 12 by any suitable means and communicates with said first annular chamber 22 for admitting air, preferably heated air, thereto. A second air conduit 28 is connected to the upstream end of dome or closure member 24 and communicates therewith for admitting air, preferably unheated primary combustion air thereto, e.g., from conduit 28 and into the primary combustion section of the flame tube. See FIG. 2. Said air conduit 28 can be connected to and communicate with the upstream end portion of said dome member 24 in any suitable manner which is effective to exclude air in said first air conduit 26 from entering the air inlet means incorporated in said dome member, but which is effective to permit air from said second air conduit 28 to enter said air inlet means. Although not shown in the drawing, the upper end of T-member 30 through which said conduit 28 extends is preferably closed. The bottom portion of said T-member comprises a portion of the conduit means 26 for supplying air, preferably heated air, to annular chamber 22.

Referring to FIGS. 2, 3, and 3*a*, said closure member can be fabricated integrally, i.e., as one element. However, in most instances it will be preferred to fabricate said closure member in a plurality of pieces, e.g., an upstream element 32, a swirl plate 34 (see FIG. 3*a*), and a downstream element or radiation shield 36. A first or primary air inlet means is provided for introducing a swirling mass of air into swirl chamber 38 which is formed between swirl plate 34 and radiation shiled 36, and then into the upstream end of the flame tube 14. As illustrated in FIGS. 2, 3, and 3*a*, said air inlet means comprises a plurality of air conduits 40 and 40' extending through said upstream member 32 and said swirl plate 34, respectively. A plurality of angularly disposed baffles 42, one for each of said air conduits 40, are formed on the downstream side of said swirl plate 34 adjacent the outlets of said air conduits 40. Any other suitable air inlet means can be used for introducing primary air into said flame tube. Preferably, said air will be introduced as a swirling stream of air.

A fuel inlet means is provided for introducing a stream of fuel into the upstream end of said flame tube. As illustrated in FIG. 2, said fuel inlet means comprises a fuel conduit 44 leading from a source of fuel, communicating with a passageway 46 formed in upstream element 32, which in turn communicates with chamber 48, also formed in element 32. A spray nozzle 50 is mounted in a suitable opening 52 in the downstream side of said element 36, extends through swirl chamber 38 and is in communication with said chamber 48. Any other suitable type of spray nozzle and fuel inlet means can be employed, including other air assist atomization nozzles. For example, it is within the scope of the invention to employ other nozzle types for atomizing normally liquid fuels such as nozzles wherein a stream of air is passed through the nozzle along with the fuel. Preferably, said fuel will be introduced axially with respect to said swirling stream of air. Preferably, the downstream end portion of said dome member 24 comprises an expansion passageway which flares outwardly from said opening 52 to the inner wall of flame tube 14.

At least one opening 54 is provided in the wall of flame tube 14 at a first station adjacent the downstream end of said primary combustion section 16 for admitting a second stream of air, preferably heated air, into said flame tube. At least one opening 56 is provided in the wall of said connecting section 19 at a second station, located downstream from but closely adjacent said first station, for admitting a third stream of air, preferably heated air, from said annular chamber 22 into said flame tube. The two stage enlargement of the flame tube at said first and second stations aids in mixing of the air introduced via openings 54 and 56 with the combustion products produced in the primary combustion section 16 and being passed, and expanded, into secondary combustion section 18. Said two stage enlargement also provides more effective flame holding over a broad range of operating conditions without excessive pressure drop than in straight can-type combustors. At least one opening is provided in the wall of the flame tube at a third station 58 located downstream from said second station. As illustrated in FIG. 1, it is usually preferred to provide a plurality of openings at said first, second, and third stations.

It will be understood the combustors described herein can be provided with any suitable type of ignition means and, if desired, means for introducing a pilot fuel to initiate burning. For example, a sparkplug (not shown) can be mounted to extend into flame tube 14 adjacent the downstream end of radiation shield 36.

Figure 4:
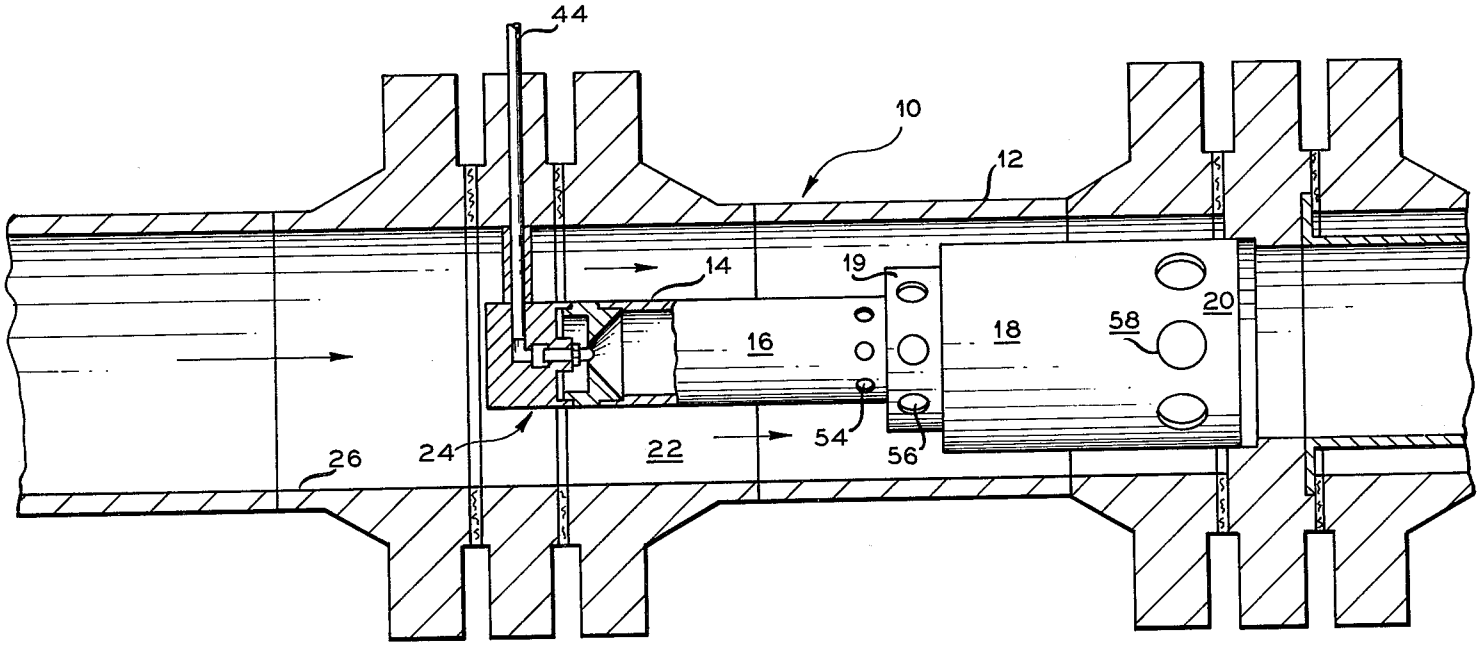

In FIG. 4 there is illustrated another combustor in accordance with the invention, also denoted generally by the reference numeral 10. Said combustor of FIG. 4 has a configuration essentially like that of the combustor of FIG. 1 except for the omission of second air conduit 28.

Figure 6:
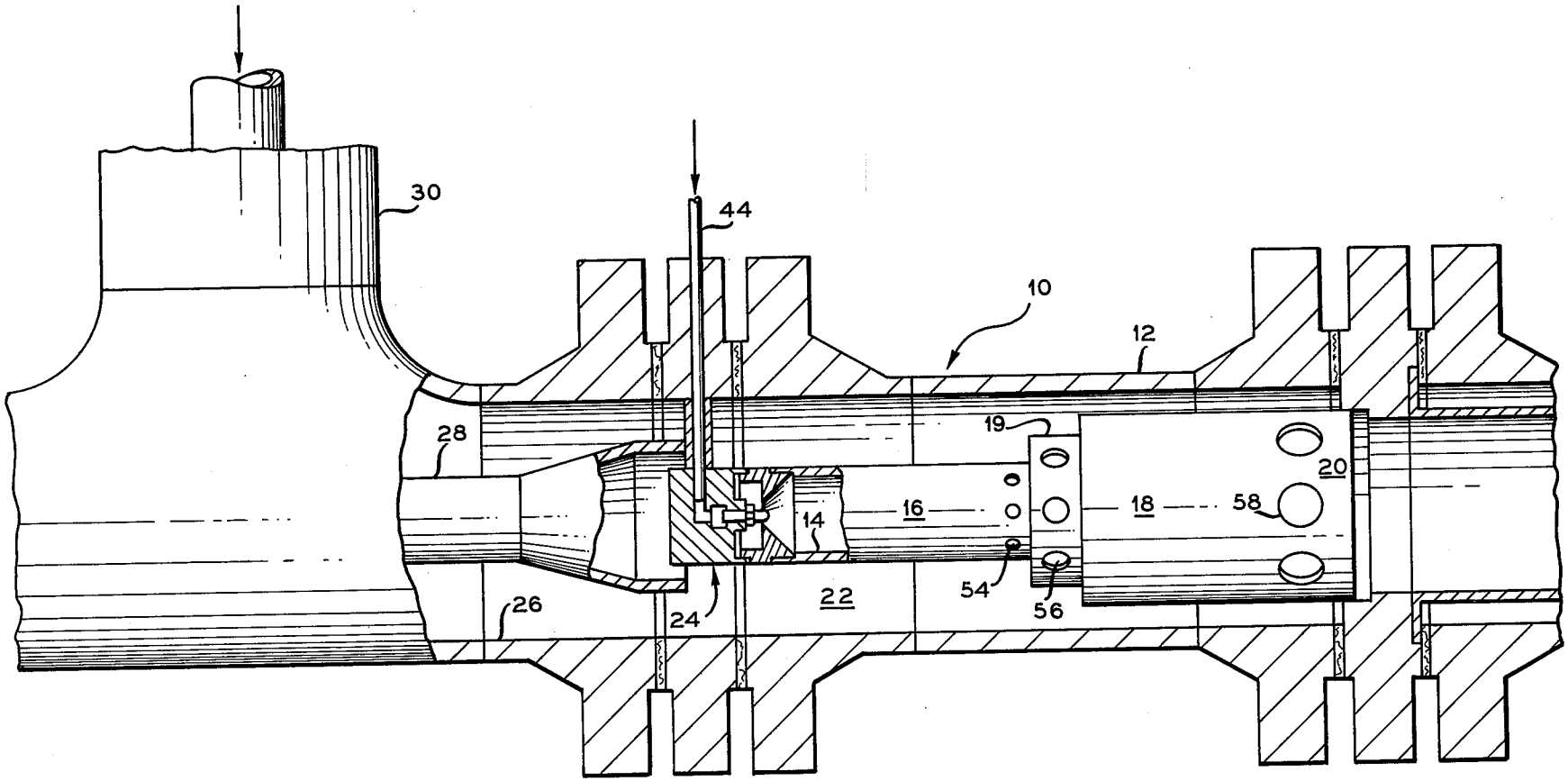

In FIG. 6 there is illustrated another combustor in accordance with the invention, also designated generally by the reference numeral 10. The combustor of FIG. 6 has a configuration essentially like that of the combustor of FIG. 1 except for the downstream end of second air conduit 28. In FIG. 6, the downstream end of secondary air conduit 28 has an enlarged cross-sectional area which is greater than and extends around, but is spaced apart from, the upstream end periphery of dome member 24. Said second air conduit 28 is disposed within said first air conduit 26 and communicates with the upstream end portion of said dome member 24 in a manner which is effective to exclude air in said first air conduit from entering the air inlet means formed in said dome member 24, but which is effective to permit air from said second air conduit to enter said air inlet means. Thus, the air from said first air conduit 26 enters only said first annular chamber 22.

Figure 5:
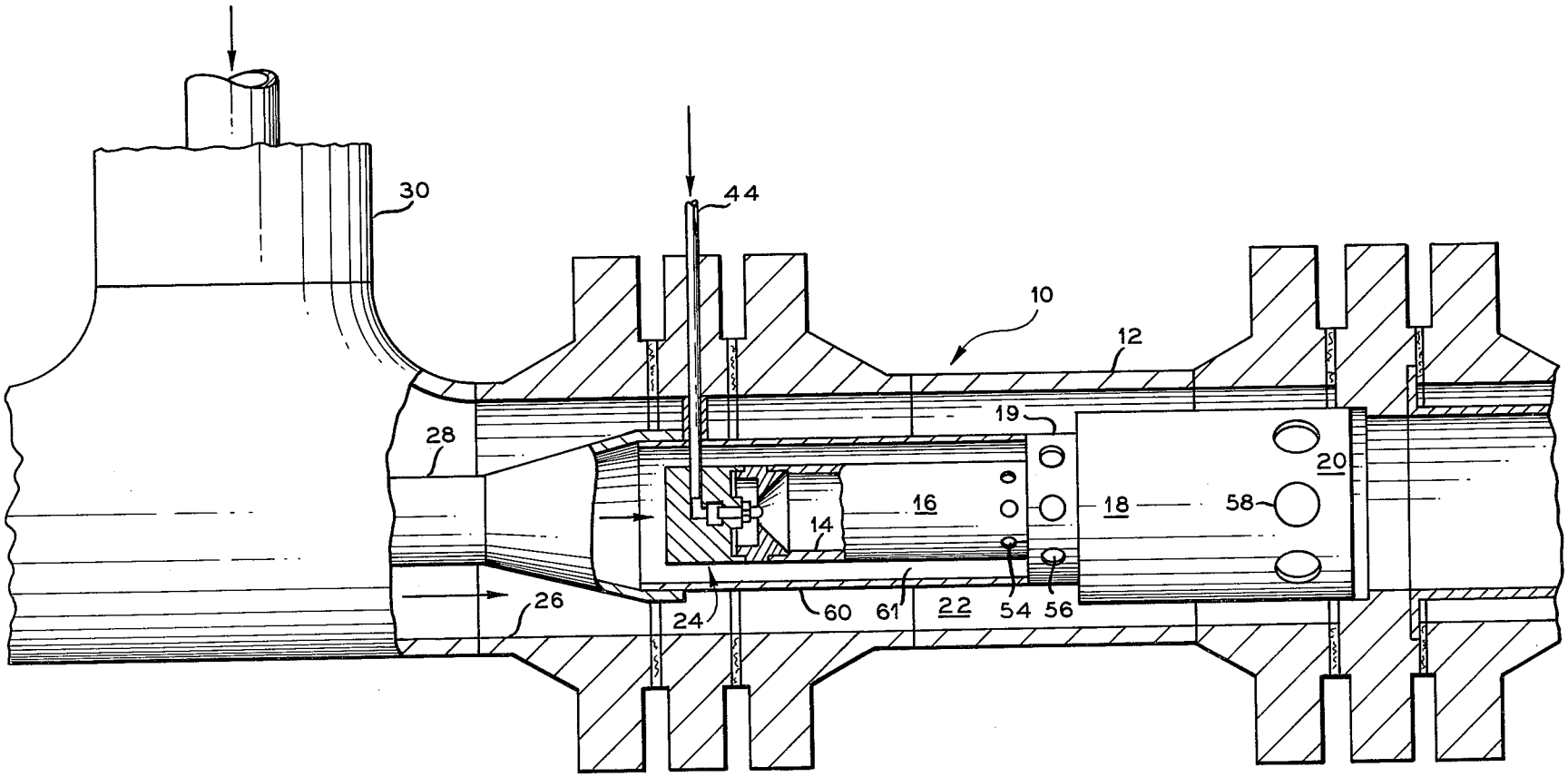

The combustor of the invention illustrated in FIG. 5 has a configuration like that illustrated in FIG. 6 except for the addition of sleeve 60. Said tubular sleeve 60 is connected to the enlarged downstream end of second air conduit 28 and extends in a downstream direction to connect with the upstream end of annular connecting section 19 to provide a second annular chamber 61 which encloses said primary combustion section 16.

The combustor of the invention illustrated in FIG. 7 has a general configuration similar to that of the combustors illustrated in FIGS. 1, 5, and 6. In the combustor of FIG. 7, the first station openings 54' at the downstream end of primary combustion section 16 have been enlarged. Also, annular connectng section 19' tapers in increasing cross-sectional area from the downstream end of primary combustion section 16 to the upstream end of the enlarged portion of secondary combustion section 18. An individual tubular conduit 62 is provided for each of said openings 54'. Each said tubular conduit 62 is connected at its inner end to an individual said opening 54', and the outer end of the conduit extends into first annular chamber 22. Preferably, said outer end of said tubular conduit 62 is beveled in an upstream direction to provide the downstream wall portion of said conduit 62 with a greater length than the upstream wall portion thereof.

Preferably, said tubular conduits 62 are formed in and extend transversely through a beveled boss member 64 which is beveled in an upstream direction and surrounds the downstream end portion of primary combustion section 16 and extends into said first annular chamber 22. A plurality of spaced-apart passages 66 are also formed in said boss member 64 and extend longitudinally therethrough between said tranversely extending conduits 62. The structure of said boss member 64 is further illustrated in FIG. 9.

FIG. 8 illustrates another type of flame tube 14' which can be employed in the combustors of the invention, e.g., the combustors of FIGS. 1, 4, 5, and 6. In said flame tube 14', at least one opening 68 is provided at a third station which is in the enlarged portion of secondary combustion section 18 and is downstream from the second station location of openings 56 in annular connecting section 19. Thus, in the flame tube 14' the openings 58 are located at a fourth station which is downstream from said third station.

In one method of operating the combustor of FIG. 1, at least a portion of a first stream of air, preferably unheated, from conduit 28 is introduced into the upstream end portion of primary combustion section 16 via openings 40, past baffles 42, and through swirl chamber 38 in dome member 24. The baffles 42 impart a helical or swirling motion to the air entering and exiting from said swirl chamber. Said swirling motion creates a strong vortex action resulting in a reverse circulation of hot gases within flame tube 14. Said first stream of air comprises and can be referred to as primary combustion air. A stream of fuel is admitted, via conduit 44 and nozzle 50 axially of said swirling stream of air. Controlled mixing of said fuel and said air occurs at the interface therebetween. The fuel, and the air from swirl chamber 38, are passed through the expansion passageway in radiation shield 36 wherein they are expanded in a uniform and graduated manner, during at least a portion of the mixing thereof, from the volume in the region of the initial contact therebetween to the volume of the primary combustion section 16.

A second stream of air, preferably heated air, is passed from conduit 26 in a downstream direction through annular chamber 22 in the region around said primary combustion section 16. A portion of said second stream of air is introduced via openings 54 into the downstream end of said primary combustion section and mixed with the combustion products produced in said primary combustion section. Said combustion products are passed via annular connecting section 19, and expanded during said passage, into the enlarged portion of secondary combustion section 18. A second portion of said second stream of air is introduced into admixture with said combustion products via openings 56 in annular connecting section 19 during said passage and expansion of said combustion products into said secondary combustion section. It will be noted that said first stream of air and said second stream of air are introduced into said combustor as, and are maintained as separate streams of air therein until they are introduced into one of said combustion zones. A third portion of said second stream of air is passed from annular chamber 22 via openings 58 into the downstream end portion of the flame tube as diluent or quench air.

The operation of the combustor illustrated in FIG. 4 is similar to that described above for the combustor illustrated in FIG. 1 except that in FIG. 4 only one main stream of heated air is supplied to the combustor. A first stream of said heated air is introduced through dome member 24 into the upstream end of primary combustion section 16 as described above in connection with FIG. 1. A second stream of said heated air is passed in a downstream direction as an annular stream of air in annular chamber 22 surrounding said primary combustion section 16. Portions of said second stream of air are introduced into the flame tube via openings 54, 56, and 58 as described above.

In one method of operation, the operation of the combustor of FIG. 5 is similar to that described above for the operation of the combustor of FIG. 1. In the combustor of FIG. 5, a first portion of said first stream of air (preferably unheated) from conduit 28 is introduced into the upstream end portion of primary combustion section 16 via dome member 24 as described above. A second portion of said first stream of air is passed in a downstream direction as an annular stream in second annular chamber 61 surrounding said primary combustion section and is introduced via openings 54 into the downstream end portion of said primary combustion section as another stream of air. Said second stream of air from conduit 26 (preferably heated) is passed as a second annular stream in annular chamber 22 around and separated from said second portion of said first stream of air, and a portion of said second stream of air from annular chamber 22 is introduced into the flame tube via openings 56 in connecting section 19 during the passage and expansion of the combustion products from primary combustion section 16 into secondary combustion section 18.

In one method of operating the combustor of FIG. 6, the operation is similar to that described above for the combustors of FIGS. 1 and 5. In the combustor of FIG. 6 a first portion of said first stream of air in conduit 28 enters conduits 40 in dome member 24 and is introduced into the upstream end portion of primary combustion section 16 as described above. A second portion of the air in conduit 28 issues from the enlarged downstream end thereof and is passed in a downstream direction as an annular stream around said primary combustion section 16 along with the second stream of air in annular chamber 22. A mixture of said portion of said first stream of air and said second stream of air is introduced via openings 54 into the downstream end portion of said primary combustion section 16 as another stream of air. Other portions of said mixture of said first stream of air and said second stream of air are introduced via openings 56 and 58 as described above.

In one method of operation, the operation of the combustor illustrated in FIG. 7 is like that of the combustor illustrated in FIG. 1. In FIG. 7, a first stream of air is introduced from conduit 28 into the upstream portion of primary combustion section 16 via dome member 24 as described above in connection with FIG. 1. Another stream of air comprising a portion of the second stream of air in annular chamber 22 is deflected or diverted by means of beveled tubular conduits 62 and directed into the downstream end portion of said primary combustion section 16. Combustion products from primary combustion section 16 are passed via connecting section 19' and expanded into secondary combustion region 18. Another portion of said second stream of air from annular chamber 22 is introduced into the flame tube via conduits or openings 58 as described above. As described above in connection with FIG. 1, it will be noted that said first stream of air in conduit 28 and said second stream of air in conduit 26 are introduced into the combustor as, and are maintained as, separate streams of air until introduced into one of the combustion sections of the combustor.

When the flame tube of FIG. 8 is employed in combustors of the invention, e.g., combustors 1, 4, 5, and 6, the operation of the combustors so equipped is similar to that described above for said combustors 1, 4, 5, and 6. The principal difference is that in the flame tube of FIG. 8 a third portion of said second stream of air in annular conduit 22 is introduced via opening 68 into admixture with the combustion products immediately after said combustion products have been passed and expanded into secondary combustion region 18.

In the above methods of operation of the combustors of the invention, combustion of said fuel is initiated at least in said primary combustion zone with said first stream of air (primary air) and essentially completed in said secondary combustion zone with stream(s) of air introduced thereto. The resulting combustion gases are quenched in said quench or dilution zone and the quenched gases exit the downstream end of the flame tube to a turbine or other utilization such as a furnace, boiler, etc.

In the above-described methods of operation the relative volumes of the various streams of air can be controlled by varying the sizes of the said openings, relative to each other, through which said streams of air are admitted to the flame tube of the combustor. Any other suitable method of controlling said air volumes can be employed. For example, flow meters or calibrated orifices can be employed in the conduits supplying said streams of air.

It is within the scope of the invention to operate the combustors or combustion zones employed in the practice of the invention under any conditions which will give the improved results of the invention. For example, it is within the scope of the invention to operate said combustors or combustion zones at inlet air temperatures within the range of from ambient to about 1500° F., or higher; at pressures within the range of from about 1 to about 40 atmospheres, or higher; at flow velocities within the range of from about 1 to about 500 feet per second, or higher; and at heat input rates within the range of from about 30 to about 1200 Btu per pound of air. Since in preferred embodiments the invention provides for reducing the temperature of the primary combustion air to the combustor or combustion zone to values less than those normally employed, so as to reduce nitrogen oxides emissions, it is preferred that the temperature of the inlet primary air be within the range of from ambient to about 700° F., more preferably from ambient to about 500° F. In said preferred embodiments the temperature of the secondary air will preferably be greater than the temperature of the primary air. The temperature of the secondary air should be at least about 100° F., preferably at least about 200° F., e.g., up to about 1200° F., or more, greater than the temperature of said primary air, depending upon the temperature of the primary air. Generally speaking, the upper limit of the temperature of the secondary air will be determined by the means employed to heat same, e.g., the capacity of the regenerator or other heating means. Generally speaking, operating conditions in the combustors employed in the practice of the invention will depend upon where the combustor is employed. For example, when the combustor is employed with a high pressure turbine, higher pressures and higher inlet air temperatures will be employed in the combustor. Thus, the invention is not limited to any particular operating conditions. As a further guide to those skilled in the art, but not to be considered as limiting on the invention, presently preferred operating ranges for other variables or parameters are: heat input, from 30 to 500 Btu/lb. of total air to the combustor; combustor pressure, from 3 to 10 atmospheres; and reference air velocity, from 50 to 250 feet per second.

The relative volumes of the above-described primary, secondary, and quench or dilution air streams will depend upon the other operating conditions. Generally speaking, the volume of the primary air introduced into the primary combustion zone will usually be in the range of from 1 to 50, preferably 2 to 35, volume percent of the total air to the combustor when operating over a driving cycle including idling, low speed, moderate speed, high speed, acceleration, and deceleration. When operating under substantially "steady state"conditions, such as in a stationary power plant or in turnpike driving, the volume of said primary air will usually be in the range of from 1 to 35, preferably about 2 to 18, volume percent of the total air to the combustor. Under both said driving cycle conditions and said "steady state" conditions, the volume of the heated secondary air will usually be in the range of from 10 to 60, preferably 15 to 45 volume percent of the total air to the combustor. The volume of the dilution or quench air can be any suitable amount sufficient to accomplish its intended purpose.

While in most instances, said primary air, said secondary air, and said dilution or quench air will originate from one common source such as a single compressor and be divided upstream from the combustor by means not shown, it is within the scope of the invention for said streams of air to originate from different or separate sources. For example, the unheated primary air can be supplied from a source different from that of the secondary air and the dilution or quench air, e.g., a separate air pump or compressor. It is also within the scope of the invention for the heated secondary air to be supplied from a separate source. Separate heating means can be provided for heating said secondary air, if convenient.

The following examples will serve to further illustrate the invention. In each of said examples a series of test runs was made to evaluate the combustors of the invention over a range of operating conditions as set forth therein.

EXAMPLE I

A series of runs was carried out employing combustors A, B, C, D, E, F, and G of the invention. The test conditions employed were within the following schedule:

| Inlet Air Pressure, Inches Hg Absolute | Primary Zone Inlet Air Temp., ° F. | Cold Flow Reference Velocity, Ft./Sec. | | |
|---|---|---|---|---|
| 130 | 1050 | — | 150 | 190 |
| 130 | 1150 | 110 | 150 | 190 |
| 130 | 1250 | — | — | 190 |

Runs were made at the above six test conditions by increasing heat-input rates from 100 to 250 Btu per pound of air, in 50 Btu per pound increments, or until the calculated exhaust temperature of approximately 2000° F. was reached. This produced a total of 18 test points or conditions. At each of said 18 test conditions the total air flow to the combustor was fixed at a value within the range of from 1.042 to 1.919 lbs/sec; the unheated air flow (when used) was metered at a value within the range of 0.026 to 0.288 lbs/sec; and the fuel flow was fixed at a value within the range of from 30.14 to 74.00 lbs/hr. The volume of the air streams to the different zones of the combustors, except the unheated air stream which was metered into the primary combustion zone, was calculated on the basis of open entry hole sizes to each zone. At each test condition the exhaust gas from the combustor was analyzed to determine the concentration of $NO_x$, CO, and unburned hydrocarbons (HC). In general, in said analyses the SAE recommended procedure was followed, i.e., "Procedure for the Continuous Sampling and Measurement of Gaseous Emissions from Aircraft Turbine Engines, " Society of Automotive Engineers, Inc., New York, Aerospace Recommended Practice 1256, (October 1971).

From the raw data thus obtained, the Emission Index (pounds of pollutant produced per 1000 pounds of fuel burned) was calculated for $NO_x$, CO, and HC. For the sake of brevity, test condition 18 was selected for reporting herein as being representative of severe conditions which favor maximum $NO_x$ production.

Operating conditions in the selected representative test condition 18 (except for temperature conditions in combustor G) were as follows: temperature of unheated air, 347° to 456° F. (estimated); temperature of heated air measured at heater outlet, 1250° F.; inlet air pressure, 130 inch Hg abs.; cold flow reference velocity, 190 ft/sec; heat input, 200 Btu per pound of air; unheated air flow (when used), 0.042 to 0.271 lbs/sec; heated air flow, 1.423 to 1.652 lbs/sec; and total air flow, 1.694 lbs/sec. Measured temperature conditions in said combustor G were as follows: unheated air to primary combustion zone, 260° F.; heated secondary air, 1190° F.; and heated quench or dilution air, 1190° F.

The configuration of combustor A was like that of the combustor illustrated in FIG. 4. Said combustor A was operated using heated air, supplied by conduit 26, in the primary combustion zone. The configurations of combustors B, C, D, and E were each like that of the combustor illustrated in FIG. 1. These combustors were operated using varying amounts of unheated air, supplied by conduit 28, in the primary combustion zone. Combustors F and G employed modified means for introducing the unheated air into the primary combustion zone. Combustor F was like combustor E except for the provision of sleeve 60 surrounding the primary combustion zone as shown in FIG. 5. Combustor G was like combustor E except that the enlarged downstream end of unheated air conduit 28 was not connected to dome member 24. See FIG. 6. Design details for said combustors are given in Table II below.

Emission Index values, and other data, from the runs at said test condition 18for each of said combustors are set forth in Table III below. Properties of the fuel used in said test runs are set forth in Table I below.

EXAMPLE II

Another series of test runs was carried out employing combustors H, J, K, L, M, and N of the invention. These combustors were modifications of the combustors employed in Example I and the differences therefrom included (a) manner of introducing secondary air, (b) amount of secondary air, and (c) relative volumes of the primary combustion zone and the secondary combustion zone. In this series of runs, 10 percent of unheated air (based on total air to the combustor) was used in the primary zone of the combustor for comparison with the run in combustor E in Example I.

The configuration of combustion H was like that of the combustor illustrated in FIG. 7. The configurations of combustors J, K, L, and M were each like that of the combustor illustrated in FIG. 1. The configuration of combustor N was also like that of the combustor illustrated in FIG. 1 except that the flame tube in said combustor N was like that illustrated in FIG. 8. Design details of said combustors are given in Table II below.

Said test runs were carried out at 18 different test conditions in a manner similar to that set forth in Example I above. In each test run the unheated air flow to the primary combustion zone of the combustor was metered at a value within the range of 0.104 to 0.192 lbs/sec, and the flow of heated air to the combustor was fixed on the basis of open hole area in the flame tube at a value within the range of 0.983 to 1.727 lbs/sec, for a total air flow within the range of from 1.042 to 1.919 lbs/sec. Operating conditions in the selected representative test condition 18 were as follows: temperature of unheated air (estimated), 347° F.; temperature of heated air (measured at heater outlet), 1250° F.; inlet air pressure, 130 inches Hg abs.; cold flow reference velocity, 190 ft/sec; heat input, 200 Btu per pound of air; unheated air flow 0.169 lbs/sec; heated air flow, 1.525 lbs/sec; and total air flow, 1.694 lbs/sec.

Emission Index values, and other data, from said representive test run at condition 18 for each combustor are set forth in Table III below. The fuel used was the same as that used in Example I.

EXAMPLE III

Another series of test runs was carried out employing combustors P, L, and R of the invention. These combustors were modifications of the combustors employed in Example I, and the differences therefrom included primarily an increase in the length and volume of the primary combustion zone and the secondary combustion zone. In this series of runs, 10 percent of the unheated air (based on total air flow to the combustor) was used in the primary combustion zone of the combustors for comparison with the run on combustor E in Example I, and the run on combustor L in Example II.

The configurations of said combustors P and R were substantially like that of combustor E, e.g., like the combustor illustrated in FIG. 1 of the drawings, except for said differences in length and volume of the primary and secondary combustion zone. The design details for said combustors are set forth in Table II below.

Said test runs were carried out in a manner and at the operating conditions set forth in Example II above. The results of the representative test run at condition 18 are set forth for each combustor in Table III below. The fuel used was the same as used in Example I.

TABLE I

PROPERTIES OF TEST FUEL

| | Philjet A-50 |
|---|---|
| ASTM Distillation, ° F. | |
| Initial Boiling Point | 340 |
| 5 vol. % evaporated | 359 |
| 10 vol. % evaporated | 362 |

TABLE I-continued

PROPERTIES OF TEST FUEL

| | Philjet A-50 |
|---|---|
| 20 vol. % evaporated | 371 |
| 30 vol. % evaporated | 376 |
| 40 vol. % evaporated | 387 |
| 50 vol. % evaporated | 398 |
| 60 vol. % evaporated | 409 |
| 70 vol. % evaporated | 424 |
| 80 vol. % evaporated | 442 |
| 90 vol. % evaporated | 461 |
| 95 vol. % evaporated | 474 |
| End Point | 496 |
| Residue, vol. % | 0.8 |
| Loss, vol. % | 0.0 |
| Gravity, degrees API | 46.6 |
| Density, lbs./gal. | 6.615 |
| Heat of Combustion, net, Btu/lb. | 18,670 |
| Hydrogen Content, wt. % | 14.2 |
| Smoke Point, mm | 27.2 |
| Sulfur, wt. % | 0.001 |
| Gum, mg/100 ml | 0.0 |
| Composition, vol. % | |
| Paraffins | 52.8 |
| Cycloparaffins | 34.5 |
| Olefins | 0.1 |
| Aromatics | 12.6 |
| Formula (calculated) | $(C_{11}H_{22})$ |
| Stoichiometric Fuel/Air Ratio, lb./lb. | 0.0676 |

TABLE II

COMBUSTOR DESIGN

| Variable | Combustor Number A & B | C | D | E |
|---|---|---|---|---|
| Dome Member | | | | |
| Air Inlet-Type | Tangent | Tangent | Tangent | Tangent |
| Hole Diameter, in. | 0.250 | 0.313 | 0.313 | 0.313 |
| Number of Holes | 6 | 6 | 6 | 6 |
| Total Hole Area, sq. in. | 0.295 | 0.460 | 0.460 | 0.460 |
| Fuel Nozzle Type | Simplex | Simplex | Simplex | Simplex |
| Spray Angle, deg. | 45 | 45 | 45 | 45 |
| Radiation Shield-Type | Orifice | Orifice | Orifice | Orifice |
| Hole Diameter, in. | 0.625 | 0.750 | 0.875 | 1.000 |
| Nozzle Annulus Area, sq. in. | 0.157 | 0.292 | 0.451 | 0.635 |
| % Total Combustor Hole Area | 1.359 | 2.499 | 3.809 | 5.281 |
| Flame-Tube | | | | |
| 1st Station-Diameter, in. | 2.067 | 2.067 | 2.067 | 2.067 |
| Length from Fuel Inlet, in. | 3.000 | 3.000 | 3.000 | 3.000 |
| Hole Diameter, in. | 0.500 | 0.500 | 0.500 | 0.500 |
| Number of Holes | 8 | 8 | 8 | 8 |
| Total Hole Area, sq. in. | 1.570 | 1.570 | 1.570 | 1.570 |
| % Total Combustor Hole Area | 13.597 | 13.440 | 13.260 | 13.057 |
| 2nd Station-Diameter, in. | 3.068 | 3.068 | 3.068 | 3.068 |
| Length from Fuel Inlet, in. | 4.000 | 4.000 | 4.000 | 4.000 |
| Hole Diameter, in. | 0.750 | 0.750 | 0.750 | 0.750 |
| Number of Holes | 8 | 8 | 8 | 8 |
| Total Hole Area, sq. in. | 3.536 | 3.536 | 3.536 | 3.536 |
| % Total Combustor Hole Area | 30.625 | 30.271 | 29.864 | 29.407 |
| 3rd Station-Diameter, in. | 4.026 | 4.026 | 4.026 | 4.026 |
| Length from Fuel Inlet, in. | 10.000 | 10.000 | 10.000 | 10.000 |
| Hole Diameter, in. | 1.000 | 1.000 | 1.000 | 1.000 |
| Number of Holes | 8 | 8 | 8 | 8 |
| Total Hole Area, sq. in. | 6.283 | 6.283 | 6.283 | 6.283 |
| % Total Combustor Hole Area | 54.417 | 53.788 | 53.065 | 52.253 |
| Total Combustor Length, in. | 11.875 | 11.875 | 11.875 | 11.875 |
| Primary Zone, in. | 4.000 | 4.000 | 4.000 | 4.000 |
| Secondary Zone, in. | 6.000 | 6.000 | 6.000 | 6.000 |
| Total Combustor Volume, cu. in. | 113.673 | 113.673 | 113.673 | 113.673 |
| Primary Zone, cu. in. | 13.422 | 13.422 | 13.422 | 13.422 |
| Secondary Zone, cu. in. | 76.382 | 76.382 | 76.382 | 76.382 |
| Total Combustor Hole Area, sq. in. | 11.546 | 11.681 | 11.840 | 12.024 |
| % Combustor Exit Area | 90.697 | 91.759 | 93.008 | 94.454 |

| Variable | Combustor Number H | J | K | L |
|---|---|---|---|---|
| Dome Member | | | | |
| Air Inlet-Type | Tangent | Tangent | Tangent | Tangent |
| Hole Diameter, in. | 0.313 | 0.313 | 0.313 | 0.313 |
| Number of Holes | 6 | 6 | 6 | 6 |
| Total Hole Area, sq. in. | 0.460 | 0.460 | 0.460 | 0.460 |
| Fuel Nozzle Type | Simplex | Simplex | Simplex | Simplex |
| Spray Angle, deg. | 45 | 45 | 45 | 45 |
| Radiation Shield Type | Orifice | Orifice | Orifice | Orifice |
| Hole Diameter, in. | 0.875 | 1.000 | 1.000 | 1.000 |
| Nozzle Annulus Area, sq. in. | 0.451 | 0.635 | 0.635 | 0.635 |
| % Total Combustor Hole Area | 6.952 | 4.156 | 5.281 | 6.844 |
| Flame-Tube | | | | |
| 1st Station-Diameter, in. | 2.067 | 2.067 | 2.067 | 2.067 |
| Length from Fuel Inlet, in. | 3.000 | 3.000 | 1.000 | 3.000 |

TABLE II-continued

| COMBUSTOR DESIGN | | | | |
|---|---|---|---|---|
| Hole Diameter, in. | 0.313X1 | 0.500 | 0.500 | 0.500 |
| Number of Holes | 8 | 8 | 8 | 8 |
| Total Hole Area, sq. in. | 2.500 | 1.570 | 1.570 | 1.570 |
| % Total Combustor Hole Area | 38.538 | 10.276 | 13.057 | 16.923 |
| 2nd Station-Diameter, in. | 4.026 | 3.068 | 3.068 | 3.068 |
| Length from fuel Inlet, in. | 10.000 | 4.000 | 2.000 | 4.000 |
| Hole Diameter, in. | 0.750 | 0.750 | 0.750 | 0.750 |
| Number of Holes | 8 | 8 | 8 | 8 |
| Total Hole Area, sq. in. | 3.536 | 3.536 | 3.536 | 3.536 |
| % Total Combustor Hole Area | 54.509 | 23.145 | 29.407 | 38.115 |
| 3rd Station-Diameter, in. | — | 4.026 | 4.026 | 4.026 |
| Length from Fuel Inlet, in. | — | 10.000 | 10.000 | 10.000 |
| Hole Diameter, in. | — | 0.75×1.75 | 1.000 | 0.750 |
| Number of Holes | — | 8 | 8 | 8 |
| Total Hole Area, sq. in. | — | 9.536 | 6.283 | 3.536 |
| % Total Combustor Hole Area | | 62.420 | 52.253 | 38.115 |
| Total Combustor Length, in. | 11.875 | 11.875 | 11.875 | 11.875 |
| Primary Zone, in. | 3.000 | 4.000 | 2.000 | 4.000 |
| Secondary Zone, in. | | | | |
| 7.000 | 6.000 | 8.000 | 6.000 | |
| Total Combustor Volume, cu. in. | 123.047 | 113.673 | 132.421 | 113.673 |
| Primary Zone, cu. in. | 10.068 | 13.422 | 6.712 | 13.422 |
| Secondary Zone, cu. in. | 89.110 | 76.382 | 101.840 | 76.382 |
| Total Combustor Hole Area, sq. in. | 6.487 | 15.277 | 12.024 | 9.277 |
| % Combustor Exit Area | 50.958 | 120.007 | 94.454 | 72.875 |

| Variable | Combustor Number M | N | P | R |
|---|---|---|---|---|
| Dome Member | | | | |
| Air Inlet-Type | Tangent | Tangent | Tangent | Tangent |
| Hole Diameter, in. | 0.313 | 0.313 | 0.313 | 0.313 |
| Number of Holes | 6 | 6 | 6 | 6 |
| Total Hole Area, sq. in. | 0.460 | 0.460 | 0.460 | 0.460 |
| Fuel Nozzle Type | Simplex | Simplex | Simplex | Simplex |
| Spray Angle, deg. | 45 | 45 | 45 | 45 |
| Radiation Shield Type | Orifice | Orifice | Orifice | Orifice |
| Hole Diameter, in. | 0.875 | 0.875 | 1.000 | 1.000 |
| Nozzle Annulus Area, sq. in. | 0.451 | 0.451 | 0.635 | 0.635 |
| % Total Combustor Hole Area | 4.078 | 3.905 | 5.281 | 6.844 |
| Flame-Tube | | | | |
| 1st Station-Diameter, in. | 3.068 | 2.067 | 2.067 | 2.067 |
| Length from Fuel Inlet, in. | 4.000 | 3.000 | 6.250 | 6.250 |
| Hole Diameter, in. | 0.750 | 0.600 | 0.500 | 0.500 |
| Number of Holes | 8 | 8 | 8 | 8 |
| Total Hole Area, sq. in. | 3.536 | 1.570 | 1.570 | 1.570 |
| % Total Combustor Hole Area | 31.973 | 13.596 | 13.057 | 16.923 |
| 2nd Station-Diameter, in. | 4.026 | 3.068 | 3.068 | 3.068 |
| Length from Fuel Inlet, in. | 5.000 | 4.000 | 7.250 | 7.250 |
| Hole Diameter, in. | 0.750 | 0.625 | 0.750 | 0.750 |
| Number of Holes | 8 | 8 | 8 | 8 |
| Total Hole Area, sq. in. | 3.536 | 2.454 | 3.536 | 3.536 |
| % Total Combustor Hole Area | 31.973 | 21.252 | 29.407 | 38.115 |
| 3rd Station-Diameter, in. | 4.026 | 4.026 | 4.026 | 4.026 |
| Length from Fuel Inlet, in. | 10.000 | 5.000 | 18.000 | 18.000 |
| Hole diameter, in. | 0.750 | 0.750 | 1.000 | 0.750 |
| Number of Holes | 8 | 8 | 8 | 8 |
| Total Hole Area, sq. in. | 3.536 | 3.536 | 6.283 | 3.536 |
| % Total Combustor Hole Area | 31.973 | 30.622 | 52.253 | 38.115 |
| 4th Station-Diameter, in. | — | 4.026 | — | — |
| Length from Fuel Inlet, in. | — | 10.000 | — | — |
| Hole Diameter, in. | — | 0.750 | — | — |
| Number of Holes | — | 8 | — | — |
| Total Hole Area, sq. in. | — | 3.356 | — | — |
| % Total Combustor Hole Area | — | 30.622 | — | — |
| Total Combustor Length, in. | 11.875 | 11.875 | 20.875 | 20.875 |
| Primary Zone, in. | 5.000 | 5.000 | 7.250 | 7.250 |
| Secondary Zone, in. | 5.000 | 5.000 | 10.750 | 10.750 |
| Total Combustor Volume, cu. in. | 104.299 | 104.299 | 197.778 | 197.778 |
| Primary Zone, cu. in. | 16.780 | 16.780 | 24.331 | 24.331 |
| Secondary Zone, cu. in. | 63.650 | 63.650 | 136.848 | 136.848 |
| Total Combustor Hole Area, sq. in. | 11.059 | 11.547 | 12.024 | 9.277 |
| % Combustor Exit Area | 86.873 | 90.706 | 94.454 | 72.875 |

Table III

| COMBUSTOR PERFORMANCE | | | | | | | | | |
|---|---|---|---|---|---|---|---|---|---|
| Comb. | Air to Primary Zone | | Air to Sec. Zone | | Air to Quench Zone | | Emission Index lbs. pollutant/-1000 lbs. fuel | | |
| No. | %[e] | Temp. ° F. | %[f] | Temp. ° F.[a] | %[f] | Temp. ° F.[a] | $NO_x$ | CO | HC |
| EXAMPLE I | | | | | | | | | |
| A | 1.4 | 1250[a] | 44.2 | 1250 | 54.4 | 1250 | 14.10 | 1.78 | 0.0 |
| B | 2.5 | 456[b] | 43.7 | 1250 | 53.8 | 1250 | 10.42 | 1.98 | 0.0 |
| C | 5.0 | 420[b] | 42.6 | 1250 | 52.4 | 1250 | 9.95 | 4.58 | 0.0 |
| D | 7.5 | 383[b] | 41.5 | 1250 | 51.0 | 1250 | 7.84 | 3.28 | 0.0 |
| E | 10.0 | 347[b] | 40.3 | 1250 | 49.7 | 1250 | 6.85 | 3.42 | 0.0 |
| F | 2.9[f] | 347[b] | 39.5 | 1250 | 57.6 | 1250 | 6.85 | 1.29 | 0.0 |
| G | 1.4[f] | 260[c] | 44.2 | 1190[d] | 54.4 | 1190[d] | 7.68 | 1.49 | 0.0 |
| EXAMPLE II | | | | | | | | | |

Table III-continued

| Comb. No. | Air to Primary Zone %[e] | Air to Primary Zone Temp. ° F. | Air to Sec. Zone %[f] | Air to Sec. Zone Temp. ° F.[a] | Air to Quench Zone %[f] | Air to Quench Zone Temp. ° F.[a] | Emission Index lbs. pollutant/1000 lbs. fuel $NO_x$ | CO | HC |
|---|---|---|---|---|---|---|---|---|---|
| COMBUSTOR PERFORMANCE | | | | | | | | | |
| E | 10.0 | 347[b] | 40.3 | 1250 | 49.7 | 1250 | 6.85 | 3.42 | 0.0 |
| H | 10.0 | 347[b] | 37.3 | 1250 | 52.7 | 1250 | 4.47 | 0.99 | 0.0 |
| J | 10.0 | 347[b] | 31.4 | 1250 | 58.6 | 1250 | 8.53 | 2.74 | 0.0 |
| K | 10.0 | 347[b] | 40.3 | 1250 | 49.7 | 1250 | 5.48 | 0.82 | 0.0 |
| L | 10.0 | 347[b] | 53.2 | 1250 | 36.8 | 1250 | 4.47 | 2.26 | 0.0 |
| M | 10.0 | 347[b] | 60.0 | 1250 | 30.0 | 1250 | 5.43 | 2.01 | 0.0 |
| N | 10.0 | 347[b] | 61.3 | 1250 | 28.7 | 1250 | 5.97 | 2.19 | 0.0 |
| EXAMPLE III | | | | | | | | | |
| E | 10.0 | 347[b] | 40.3 | 1250 | 49.7 | 1250 | 6.85 | 3.42 | 0.0 |
| P | 10.0 | 347[b] | 40.3 | 1250 | 49.7 | 1250 | 8.52 | 5.25 | 0.07 |
| L | 10.0 | 347[b] | 53.2 | 1250 | 36.8 | 1250 | 4.47 | 2.26 | 0.0 |
| R | 10.0 | 347[b] | 53.2 | 1250 | 36.8 | 1250 | 4.19 | 1.39 | 0.04 |

[a]approximate, measured at air heater outlet
[b]estimated
[c]measured at dome member 24
[d]measured at inlet to zone
[e]metered, % of total air flow
[f]% of total air flow, based on open hole area in flame tube Referring to the above Table III, Example I, and comparing the results from the runs in combustors A, B, C, D, and E, it is evident that $NO_x$ emissions are markedly reduced by using unheated air in the primary combustion zone, and that the extent of the reduction increases with increasing amounts of said unheated air. Comparing the results obtained in combustor E with the results obtained in combustors F and G indicates it is not too critical as to how said unheated air is introduced into the primary combustion zone because a marked reduction in $NO_x$ and CO emissions was obtained in all instances. However, said data indicates that the method employed in combustor G is less desirable than the method employed in combustor E.

Referring to the above Table III, Example II, and comparing the results obtained in combustor E with the results obtained in combustors H, J, K, L, M, and N, shows that the overall beneficial effect of using unheated air in the primary combustion zone does not depend upon the manner in which the secondary air is introduced into the secondary combustion zone.

However, based on the Emission Index values of 4.47 for $NO_x$ and 0.99 for CO obtained in combustor H, it appears that the configuration of combustor H is more effective than the other combustor configurations when one considers both $NO_x$ and CO emissions. The reason(s) for these results is not completely understood at this time. While it is not intended to limit the invention by any theories as to the operation of said combustor H, it is presently believed that the directing conduits 62 on the secondary air inlets in combustor H contribute to the results obtained. It is believed said directing conduits more positively direct the secondary air into the flame tube, promote better mixing, and provide more rapid transition from the fuel-rich conditions existing in the primary combustion zone to the fuel-lean conditions existing in the secondary combustion zone. It is also presently believed that the tapered expansion or connecting section contributes to the lower $NO_x$ value by providing a uniform expansion region and thus eliminating flame holding areas.

Comparing the results obtained with combustors E, J, and L in said Example II, and also considering the results obtained in combustors H, M, and N, indicates that the preferred amount of secondary air to be used under the severe conditions there employed is within the range of about 37 percent to about 55 percent of the total air to the combustor, especially when 10 percent unheated air is used in the primary combustion zone. It appears that the 31 percent secondary air used in combustor J is too low, and that with above about 55 percent secondary air as used in combustors M and N, the $NO_x$ Emission Index increases.

Referring to the above Table III, Example III, and comparing the results obtained in "short" combustor E with the results obtained in "long" combustor P, and comparing the results obtained in "short" combustor L with the results obtained in "long" combustor R, indicates that the overall beneficial effect of using unheated air in the primary combustion zone is not dependent upon combustor length, e.g., length and volume of the primary combustion and the secondary combustion zone.

Comparing the results obtained in "short" combustor E with the results obtained in "short" combustor L, and comparing the results obtained in "long" combustor P with the results obtained in "long" combustor R, shows that in both instances increasing the amount of secondary air from 40.3 percent to 53.2 percent of the total air to the combustor resulted in a marked decrease in both $NO_x$ and CO emissions, under the severe conditions there employed.

Based on the data given in the above Table III, it is concluded that the combustors of the invention comprise a practical, flexible design or concept capable of being employed in combustion processes from which marked reductions in $NO_x$ and CO emissions can be obtained. Said data show that the combustors of the invention are particularly well adapted to use unheated air in the primary combustion zone. Furthermore, while no data are given herein, data are available which show that combustors in accordance with the invention give good performance in transient operating conditions. In runs made under the above-described 18 test conditions wherein snap accelerations and snap decelerations were employed, there was no evidence of overshoot in exhaust emissions of CO and HC which might indicate an unstable overloading in the flame zone in the combustor.

In the above examples combustor A, using heated air to both the primary combustion zone and the secondary combustion zone, has been employed as a "control" to illustrate the advantages of using unheated air in the primary combustion zone. However, said combustor A No adjustment has been made for the relatively dry inlet air used in the test runs (about 0.002 lbs. $H_2O$ per pound of dry air). Therefore, a multiplicative correction factor in the order of about 0.85 could be applied to the $NO_x$ values reported herein.

While the invention has been described, in some instances, with particular reference to combustors employed in combination with gas turbine engines, the invention is not limited thereto. The combustors of the invention have utility in other applications, e.g., boilers, other stationary power plants, etc.

Thus, while certain embodiments of the invention have been described for illustrative purposes, the invention is not limited thereto. Various other modifications or embodiments of the invention will be apparent to those skilled in the art in view of this disclosure. Such modifications or embodiments are within the spirit and scope of the disclosure.

I claim:

1. In a combustor comprising, in combination, a tubular outer casing, a flame tube disposed within said casing and spaced apart therefrom to form a first annular chamber between said flame tube and said casing, a first air inlet means for introducing a first stream of air into the upstream end portion of said flame tube, and a fuel inlet means for introducing fuel into the upstream end portion of said flame tube, the improvements comprising, in combination:

a flame tube having an upstream primary combustion section of uniform cross-sectional area and having an essentially smooth internal wall surface, an intermediate secondary combustion section of greater cross-sectional area than said primary combustion section and having an essentially smooth internal wall surface, and a downstream quench or dilution section having an essentially smooth internal wall surface;

means for introducing air from the first annular chamber into said primary combustion section solely at a first station located adjacent the downstream end of said primary combustion chamber and adjacent the upstream end of the annular connecting section described hereinafter comprising at least one opening provided in the wall of said primary combustion section at said first station for admitting a second stream of air from said first annular chamber into the interior of said flame tube in a radial direction only; and an annular connecting section of greater cross-sectional area than said primary combustion section joined in sealed engagement at its upstream end to the downstream end of said primary combustion section around the periphery thereof and joined in sealed engagement around the periphery of its downstream end to the upstream end of said secondary combustion section, and comprising the upstream end portion of said secondary combustion section, wherein air is prevented from entering into said connecting section other than in a radial direction.

2. A combustor according to claim 1 wherein the downstream portion of said secondary combustion section is enlarged and has a greater cross-sectional area than said connecting section.

3. A combustor according to claim 2 wherein:

said primary combustion section is generally circular in cross section throughout its length;

said connecting section is generally circular in cross section throughout its length; and at least one opening is provided in the wall of said connecting section and comprises a second station for admitting a third stream of air from said first annular chamber into the interior of said flame tube.

4. A combustor comprising, in combination:

a tubular outer casing;

a flame tube disposed within said casing and spaced apart therefrom to form a first annular chamber between said flame tube and said casing, said flame tube having an upstream primary combustion section of uniform cross-sectional area, an intermediate secondary combustion section of greater cross-sectional area than said primary combustion section, and a downstream quench or dilution section;

fuel inlet means for introducing fuel into the upstream end portion of said flame tube;

a closure member disposed in and closing the upstream end of said primary combustion section;

a first air inlet means comprising at least one conduit means formed in and extending through said closure member into communication with said primary combustion section for introducing a first stream of air into said primary conbustion section;

a first air conduit connected to the upstream end of said casing for introducing air into said annular chamber;

at least one opening provided in the wall of said primary combustion section at a first station located adjacent the downstream end thereof for admitting a second stream of air from said first annular chamber into the interior of said flame tube;

a second air conduit means disposed within said first air conduit for providing a stream of air separate from the stream of air in said first air conduit, and communicating with the upstream end portion of said closure member in a manner which is effective to permitt air in said second air conduit to enter and pass through said first air inlet means into said primary combustion section, but which is effective to exclude air in said first air conduit from entering and passing through said first air inlet means into said primary combustion section; and an annular connecting section of greater cross-sectional area than said primary combustion section joined in sealed engagement at its upstream end to the downstream end of said primary combustion section around the periphery thereof and joined in sealed engagement around the periphery of its downstream end to the upstream end of said secondary combustion section, and comprising the upstream end portion of said secondary combustion section, wherein air is prevented from entering into said connecting section other than in a radial direction, and with the downstream portion of said secondary combustion section having a greater cross-sectional area than said connecting section.

5. A combustor according to claim 4 wherein the downstream end of said air conduit is connected to the upstream end of said closure member.

6. A combustor according to claim 4 wherein the downstream end of said second air conduit has a cross-sectional area greater than and extends around but is spaced apart from the upstream end periphery of said closure member.

is a low emissions combustor in accordance with the invention. Comparison of the above results obtained in combustor A using heated air in both the primary and secondary combustion zones, with results obtained in conventional combustors using heated air in both the primary and secondary combustion zones, will show that combustor A gives markedly less emissions than said conventional combustors.

The data set forth in the above Table III show that the combustors of the invention can be operated in accordance with the invention to give low $NO_x$, low CO, and low HC emissions when using an atomized liquid fuel. It is also within the scope of the invention to use a prevaporized fuel. The various operating variables or parameters utilized in the practice of the invention are interrelated. Thus, a change in one variable or parameter may make it desirable to adjust one or more of the other operating variables or parameters in order to obtain desirable results with respect to all three pollutants $NO_x$, CO, and HC (hydrocarbons).

In presently preferred methods of the invention, the primary combustion zone or section is preferably operated fuel-rich with respect to the primary air admitted thereto. Thus, the equivalence ratio in the primary combustion zone is preferably greater than stoichiometric. In this method of operation, the second zone (secondary combustion zone) or section of the combustor is preferably operated fuel-lean with respect to any unburned fuel and air entering said second zone from said primary zone, and any additional air admitted to said second zone. Thus, the equivalence ratio in said second zone preferably is less than stoichiometric. This method of operation is preferred when it is desired to obtain both low $NO_x$ and low CO emissions from a combustor. In general, it is preferred that the transition from the fuel-rich condition in the primary combustion zone to the fuel-lean condition in the secondary zone be sharp or rapid, e.g., be effected as quickly as possible. While it is presently preferred that the primary combustion zone be operated fuel-rich as described, it is within the scope of the invention to operate the primary combustion zone fuel-lean. Thus, it is within the scope of the invention to operate the primary combustion zone with any equivalence ratio which will give the improved results of the invention.

As used herein and in the claims, unless otherwise specified, the term "equivalence ratio" for a particular zone is defined as the ratio of the fuel flow (fuel available) to the fuel required for stoichiometric combustion with the air available. Stated another way, said equivalence ratio is the ratio of the actual fuel-air mixture to the stoichiometric fuel-air mixture. For example, an equivalence ratio of 2 means the fuel-air mixture in the zone is fuel-rich and contains twice as much fuel as a stoichiometric mixture.

The data in the above examples show that the temperature of the inlet air to the primary combustion zone or region can be an important operating variable or parameter in the practice of the methods of the invention. As stated above, the invention is not limited to any particular range or value for said inlet air temperature. It is within the scope of the invention to use any primary air inlet temperature which will give the improved results of the invention. For example, from ambient or atmospheric temperatures up to about 1500° F. or higher. However, considering presently available practical materials of construction, about 1200° to about 1500° F. is a practical upper limit for said primary air inlet temperature in most instances. Considering other practical aspects, such as not having to cool the compressor discharge stream, about 200° to 400° F. is a practical lower limit for said primary air inlet temperature in many instances. However, it is emphasized that primary air inlet temperatures lower than 200° F. can be used, e.g., in low compression ratio combustors.

The temperature of the air admitted to the second zone or region of the combustor (secondary air) can also be an important operating variable or parameter, particularly when the lower primary air inlet temperatures are used, and it is desired to obtain low CO emission values as well as low $NO_x$ emission values. Said data show that both low $NO_x$ emission values and low CO emission values can be obtained when the temperature of the inlet air to both the primary combustion zone and the secondary combustion zone of the combustor are above about 1100° F. As the temperature of the inlet air to said zones decreases, increasingly improved (lower) values for $NO_x$ emissions will be obtained, but it becomes more difficult to obtain desirably low CO emission values. In some instances, it is preferred that the temperature of the inlet air to the primary combustion zone not be greater than about 700° F., e.g., from ambient to about 700° F., more preferably from ambient to about 500° F. Thus, in some embodiments of the invention, it is preferred that the temperature of the air admitted to the secondary combustion zone of the combustor be greater than the temperature of the primary air admitted to the primary combustion zone. For example, in such instances, depending upon the temperature of the inlet air to the primary combustion zone, it is preferred that the temperature of the inlet air to the secondary zone be in the range of from at least about 100° to about 1200° F., more preferably at least about 200° F. greater than the temperature of said inlet primary air. Any suitable means can be employed for heating said secondary air. The temperature of the dilution or quench air can be any suitable temperature depending upon materials of construction in the equipment employed downstream from the combustor, e.g., turbine blades, and how much it is desired to cool and/or dilute the combustor effluent.

In conventional operation of conventional combustors of the prior art all of the air supplied to the combustor is heated, usually to a temperature in the order of 1000° F., or greater. In preferred embodiments of the present invention a stream of "unheated air" is supplied to the primary combustion zone or section. Said "unheated air" can have a temperature greater than ambient temperatures. For example, the air from the discharge of a compressor, if not cooled, will usually have a temperature greater than ambient temperatures. Such a stream would be "unheated air" as the term is used herein. Thus, as used herein, said term "unheated air" refers to air which has not been intentionally heated. The temperature of said "unheated air" will usually be less than about 700° F., preferably less than about 500° F.

The term "air" is employed generically herein and in the claims, for convenience, to include air and other combustion-supporting gases.

The Emission Index values referred to herein were related to the various governmental agencies' standards by assuming that the vehicle in which the gas turbine engine is employed will obtain a fuel economy of 10.0 miles per gallon of fuel, and using a fuel weight of 6.352 pounds per gallon.

7. A combustor according to claim 4 wherein a tubular sleeve is connected to said downstream end of said second air conduit and extends in a downstream direction to connect with the upstream end of said annular connecting section to provide a second annular chamber enclosing said primary combustion section.

8. A combustor according to claim 4 wherein said annular connecting section tapers in increasing cross-sectional area from the downstream end of said primary combustion section to the upstream end of said enlarged portion of said secondary combustion section.

9. A combustor according to claim 8 wherein:

a tubular conduit is connected at its inner end to said opening in said primary combustion section at said first station;

the outer end of said tubular conduit extends into said first annular chamber; and said outer end of said tubular conduit is beveled in an upstream direction to provide the downstream wall portion of said conduit with a greater length than the upstream wall portion thereof.

10. A combustor comprising, in combination:

a tubular outer casing;

a flame tube disposed within said casing and spaced apart therefrom to form a first annular chamber between said flame tube and said casing, said flame tube having an upstream primary combustion section of uniform generally circular cross-sectional area, an intermediate secondary combustion section of greater cross-sectional area than said primary combustion section, and a downstream quench or dilution section;

fuel inlet means for introducing fuel into the upstream end portion of said flame tube;

a closure member disposed in and closing the upstream end of said primary combustion section;

a first air inlet means comprising at least one conduit means formed in and extending through said closure member into communication with said primary combustion section for introducing a first stream of air into said primary combustion section;

a first air conduit connected to the upstream end of said casing for introducing air into said annular chamber;

at least one opening provided in the wall of said primary combustion section at a first station located adjacent the downstream end thereof for admitting a second stream of air from said first annular chamber into the interior of said flame tube;

a second air conduit means disposed within said first air conduit for providing a stream of air separate from the stream of air in said first air conduit, and communicating with the upstream end portion of said closure member in a manner which is effective to permit air in said second air conduit to enter and pass through said first air inlet means into said primary combustion section, but which is effective to exclude air in said first air conduit from entering and passing through said first air inlet means into said primary combustion section;

an annular connecting section of greater cross-sectional area than said primary combustion section joined in sealed engagement at its upstream end to the downstream end of said primary combustion section around the periphery thereof and joined in sealed engagement around the periphery of its downstream end to the upstream end of said secondary combustion section, and comprising the upstream end portion of said secondary combustion section, wherein air is prevented from entering into said connecting section other than in a radial direction, and with the downstream portion of said secondary combustion section having a greater cross-sectional area than said connecting section; and at least one opening provided in the wall of said connecting section and comprising a second station for admitting a third stream of air from said first annular chamber into the interior of said flame tube.

11. A combustor according to claim 10 wherein at least one opening is provided in said enlarged portion of said secondary combustion section adjacent the upstream end thereof.

12. A combustor according to claim 10 wherein:

a plurality of said openings are provided at said first station adjacent, and are spaced apart around, said downstream end of said primary combustion section;

a plurality of said openings are provided at said second station and are spaced apart around said connecting member;

said first air inlet means comprises a generally cylindrical swirl chamber formed in said closure member with the downstream end of said swirl chamber in communication with the upstream end of said primary combustion section for introducing a swirling stream of air into said primary combustion section, and a plurality of conduits extending through said closure member from the upstream end thereof and into communication with said swirl chamber for introducing air into said swirl chamber;

said fuel inlet means comprises conduit means formed in said closure member and extending through said swirl chamber for introducing said fuel axially with respect to said swirling stream of air; and the downstream end portion of said closure member comprises an expansion passageway which flares outwardly from an opening in the downstream end of said swirl chamber to the inner wall of said primary combustion section.

13. A combustor according to claim 12 wherein:

a beveled boss member, beveled in an upstream direction, surrounds the downstream end portion of said primary combustion section and extends into said first annular chamber;

a plurality of spaced apart individual tubular conduits extend transversely through said boss member with each said conduit connecting individually to individual openings of a like said plurality of openings at said second station;

a plurality of spaced apart passageways extend longitudinally through said boss member between said transversely extending tubular conduits; and said annular connecting section tapers in increasing cross-sectional area from the downstream end of said boss member and said primary combustion section to the upstream end of said enlarged portion of said secondary combustion section.

* * * * *